US006877546B1

(12) United States Patent
Garcia

(10) Patent No.: US 6,877,546 B1
(45) **Date of Patent: *Apr. 12, 2005**

(54) SPROCKET ASSEMBLY FOR LOUVER ARCH MECHANISM

(76) Inventor: Eduardo Garcia, 4414 SW. 11th St., Miami, FL (US) 33134

( * ) Notice: Subject to any disclaimer, the term of this patent is extended or adjusted under 35 U.S.C. 154(b) by 0 days.

This patent is subject to a terminal disclaimer.

(21) Appl. No.: 10/636,876

(22) Filed: Aug. 8, 2003

Related U.S. Application Data

(63) Continuation-in-part of application No. 10/387,584, filed on Mar. 14, 2003, now Pat. No. 6,758,256.

(51) Int. Cl.[7] ..... E06B 3/94
(52) U.S. Cl. ..... 160/134; 160/84.07; 49/74.1
(58) Field of Search ..... 160/134, 84.01, 160/84.07, 168.1 V, 172 V, 178.2 R, 370.21, 38, 330; 49/74.1, 87.1

(56) References Cited

U.S. PATENT DOCUMENTS 602,967 A * 4/1898 Wells ..... 160/134
1,447,189 A 3/1923 Simon ..... 49/41
4,776,380 A * 10/1988 Lester ..... 160/134
5,584,329 A * 12/1996 Thomas ..... 160/134
5,662,153 A * 9/1997 Rosenblatt ..... 160/84.07
5,794,680 A * 8/1998 Xue ..... 160/84.07
5,887,386 A * 3/1999 Alexanian et al. ..... 49/403
6,029,733 A * 2/2000 Xue ..... 160/84.07
6,145,569 A * 11/2000 Shaw et al. ..... 160/84.07
6,341,447 B1 * 1/2002 Jean ..... 49/74.1
6,390,172 B1 * 5/2002 Fleishman et al. .... 160/168.1 V
6,655,091 B1 * 12/2003 Iwasaki ..... 49/403
2003/0085007 A1 * 5/2003 Hintennach et al. ... 160/370.21

* cited by examiner

*Primary Examiner*—Bruce A. Lev
(74) *Attorney, Agent, or Firm*—J. Sanchelima; A. Bordas

(57) ABSTRACT

A sprocket assembly for a louver arch assembly for semi-circular, non-perfect or imperfect arch frame assemblies with louvers rotably mounted therein. A tensioning mechanism keeps the louvers taut between an arched frame member and a smaller anchorage frame member. An actuating mechanism is used to rotate the louvers upon the application of a predetermined force to a chain that coacts with the sprocket assemblies coupled with hooked clip members that removably hold the louvers. The sprocket assembly includes a through opening and a socket with cooperative dimensions to receive the headed end of a pin, and an internal inwardly extending pin. A longitudinal channel is cooperatively disposed to receive the inwardly extending pin therein. In this manner, the louvers are rotated between two extreme positions.

6 Claims, 5 Drawing Sheets

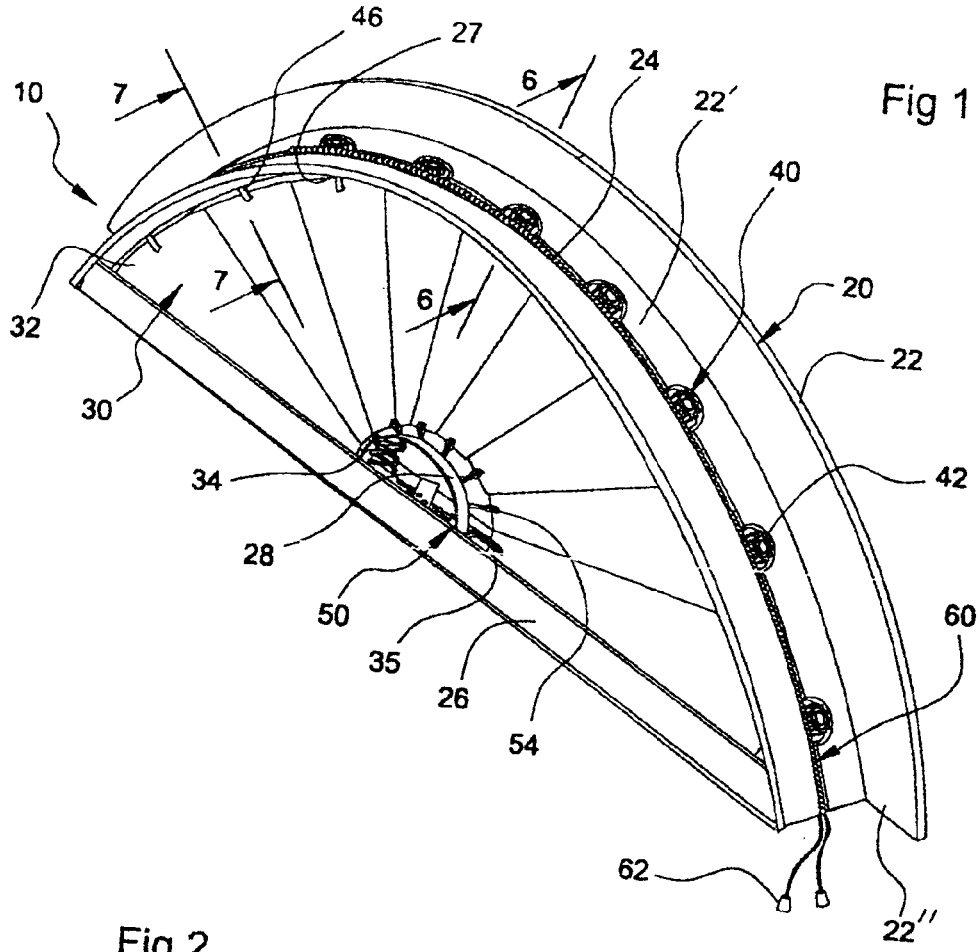
Fig 1
Fig 2
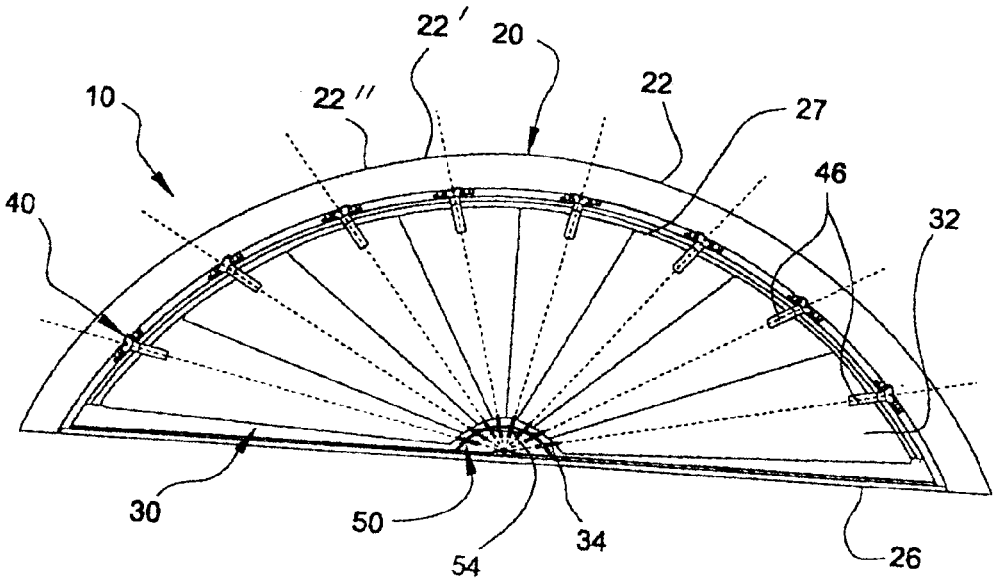

SPROCKET ASSEMBLY FOR LOUVER ARCH MECHANISM

RELATED APPLICATIONS

The present application is a continuation-in-part of U.S. patent application Ser. No. 10/387,584, filed on Mar. 14, 2003 now U.S. Pat. No. 6,758,256 for a louvered arch mechanism, which is hereby incorporated by reference.

BACKGROUND OF THE INVENTION

1. Field of the Invention

The present invention relates to an improved sprocket assembly for a louver mechanism for semi-circular, non-perfect or imperfect arch frame assemblies, and more particularly, to such a sprocket assembly that includes plurality of louvers or blinds that are radially disposed with a common central point.

2. Description of Other Related Art

Many designs for louvered arch mechanisms have been designed in the past. These mechanisms are used in arches that are typically positioned above doors and windows horizontally. None of them, however, has the blinds taut at one end while the other end (distal end) extends radially outwardly and is actuated (rotated) in tandem with a common link. A user remotely rotates the louvers. This sprocket assembly has the advantage of being substantially flush with the arched member and compatible with imperfect arch frames.

Applicant believes that the closest reference corresponds to U.S. Pat. No. 1,447,189 issued to Simon on Mar. 6, 1923. Simon's patented invention includes a frame assembly (1) with horizontal piece (2) and semi-circular or arcuated pieces (3 and 4), slats (5) with wire framework (10), block (11) and arcuated (actuating) member (19) with the consequently structural exposure. The ends (12 and 13) of framework (10) are mounted to lower arcuated piece (4). In Simon's, the slats (5) are pivotally mounted to a fixed concentric member (arcuated piece 3) and the distal ends of the blinds are actuated with arcuated members (19) connected to one of the pivot point. Also, it is doubtful that Simon's patented invention could not work for blinds mounted in tandem, specifically for more than three blinds contiguously mounted. However, it differs from the present invention because the distal ends of the blinds are actuated with a common link connected to a gear assembly mounted to the center of the distal end. Also, there is no suggestion as to how to correct the problem of imperfect arches.

In semi-circular and non-perfect or imperfect arch frame assemblies, the radius of curvature is different at different points of the arch and for most blinds, the counterbore shoulder (where the sprocket assembly rests) is not in a perpendicular disposition with respect to the longitudinal axis of the pin member. In the parent application, the disposition of internal radially extending grooves (143') and pin members (141) works for semi-circular and non-perfect or imperfect arch frame assemblies where the angle defined between the counterbore shoulder with respect to the longitudinal axis of the pin member is less than 45 degrees. For angles greater than 45 degrees, the downward movement of pin members (141) may be limited (depending of the position) by the configuration of radially grooves (143') that converge in through opening (143). The present application obviates the limitations found in pronounced arches. The improved sprocket assembly in the present application obviates this problem.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a sprocket assembly to be used in louver arch assemblies for semi-circular or non-perfect arch frame assemblies of different radius of curvature where the louvers are remotely actuated and rotated between two extreme positions.

It is another object of this invention to provide a system that is volumetrically efficient and capable of being mounted with minimum effort.

It is still another object of the present invention to provide a system that imparts the rotational movement to the clips centrally mounted to the distal ends of the louvers.

It is still another object of the present invention to provide a system that can be used for semi-circular and non-perfect or imperfect arch frame assemblies with any radius of curvature.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric view for one of the preferred embodiments for the louvered arch mechanism actuated by the sprocket assembly object of the present invention.

FIG. 2 represent a front elevational view of the embodiment represented in FIG. 1, showing different angular disposition of the blinds with respect to the tangent of the point on the arch where the blinds are centrally supported.

DETAILED DESCRIPTION OF THE PREFERRED EMBODIMENT

Figure 3:
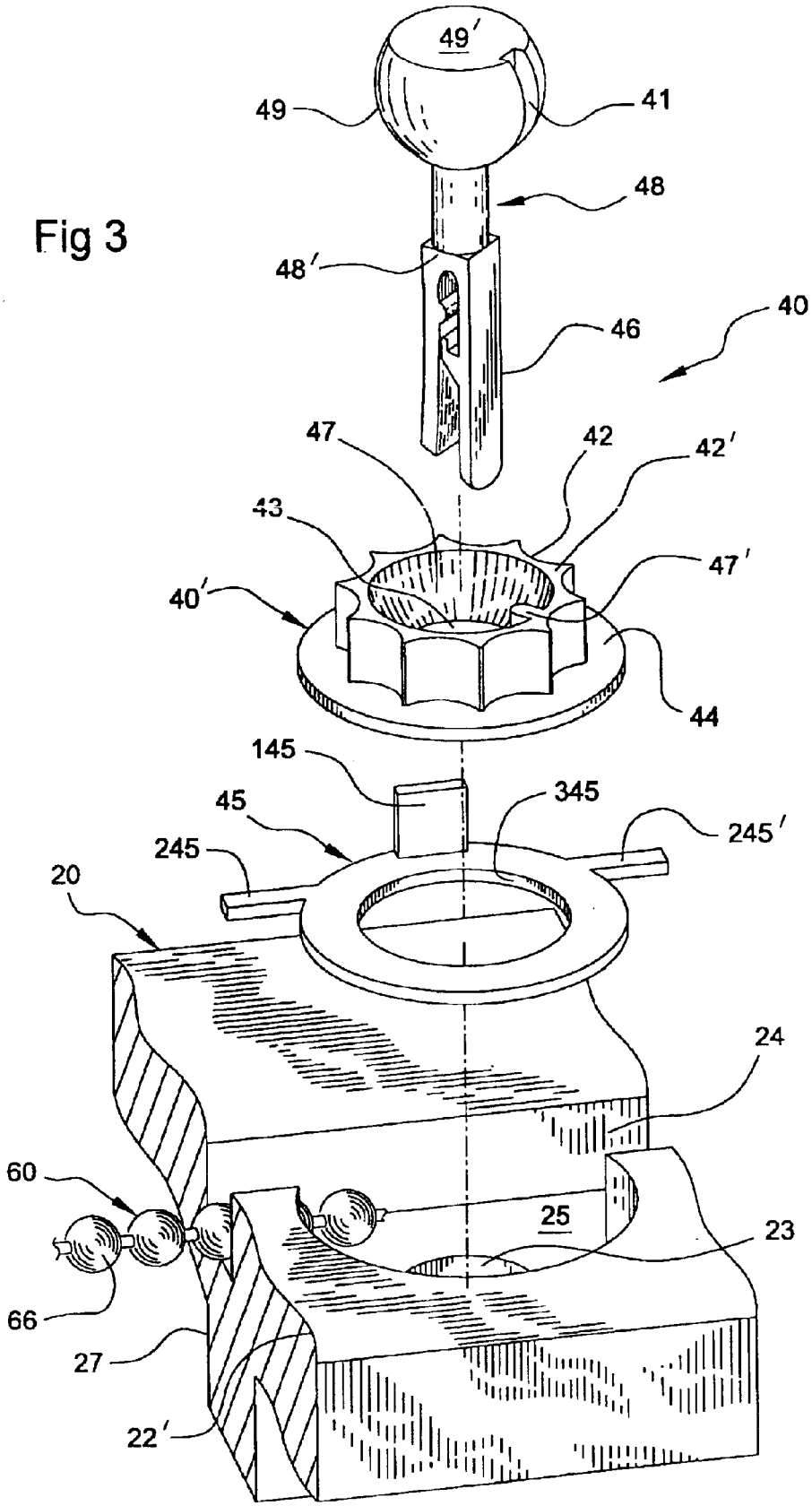
FIG. 3 illustrates an exploded view of the sprocket assembly object of the present invention.
Figure 4:
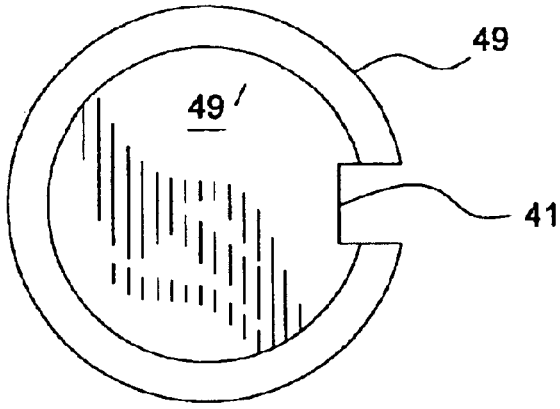
FIG. 4 shows a top view of the headed end the headed pin represented in FIG. 3, showing the longitudinal channel.

Referring now to the drawings, where the present invention is generally referred to with numeral 10, it can be observed that it basically includes frame assembly 20, blinds or louver members 30, actuating mechanism assembly 40, tensioning assembly 50 and chain 60.

Figure 6:
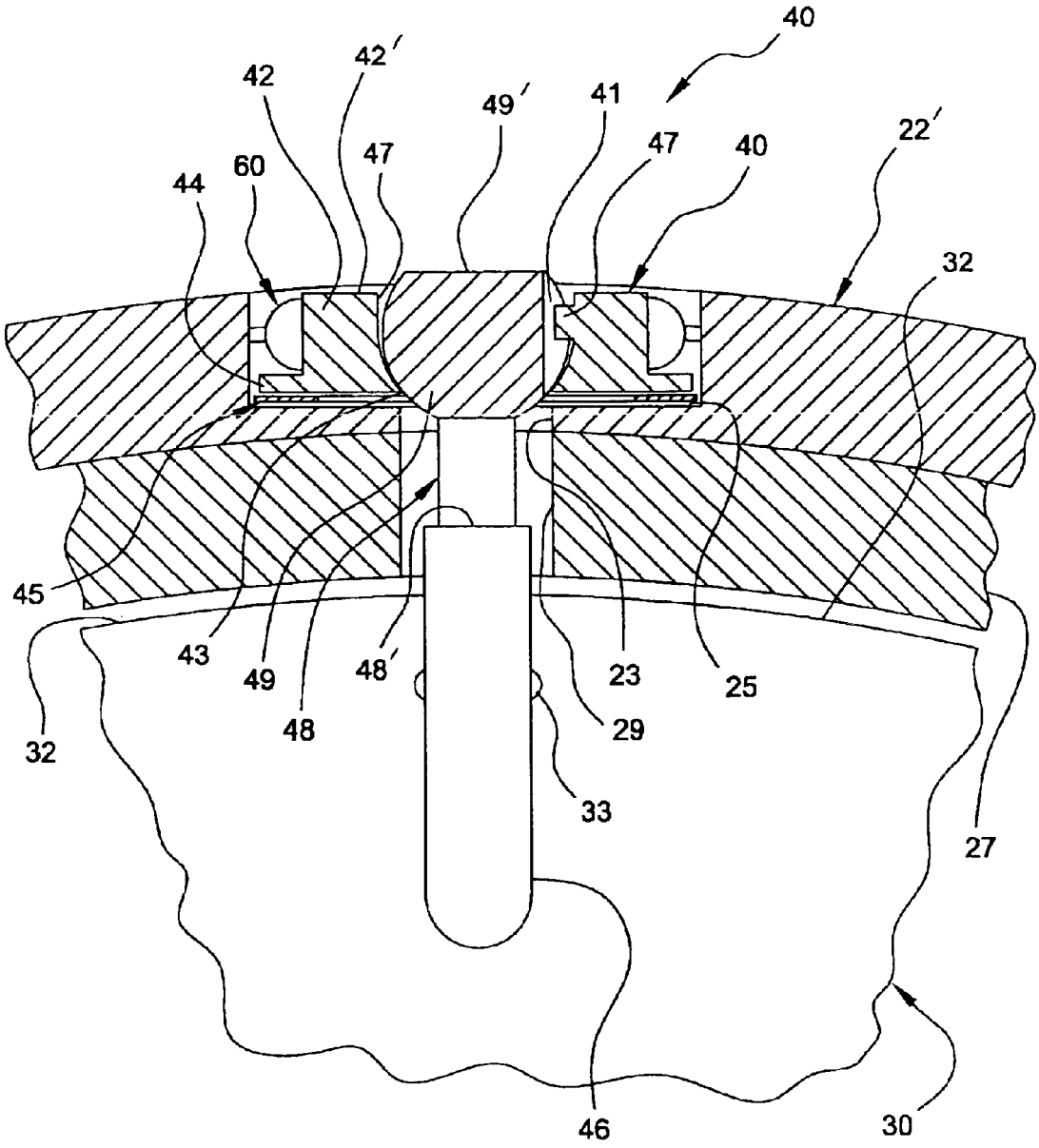
FIG. 6 represents a cross section view taken along line 6—6 in FIG. 1, showing the disposition of the headed pin within the sprocket assembly located in the central portion the arched frame member, where the blinds' axes are in a substantially perpendicular disposition with respect to the tangent of the arch at that point.
Figure 7:
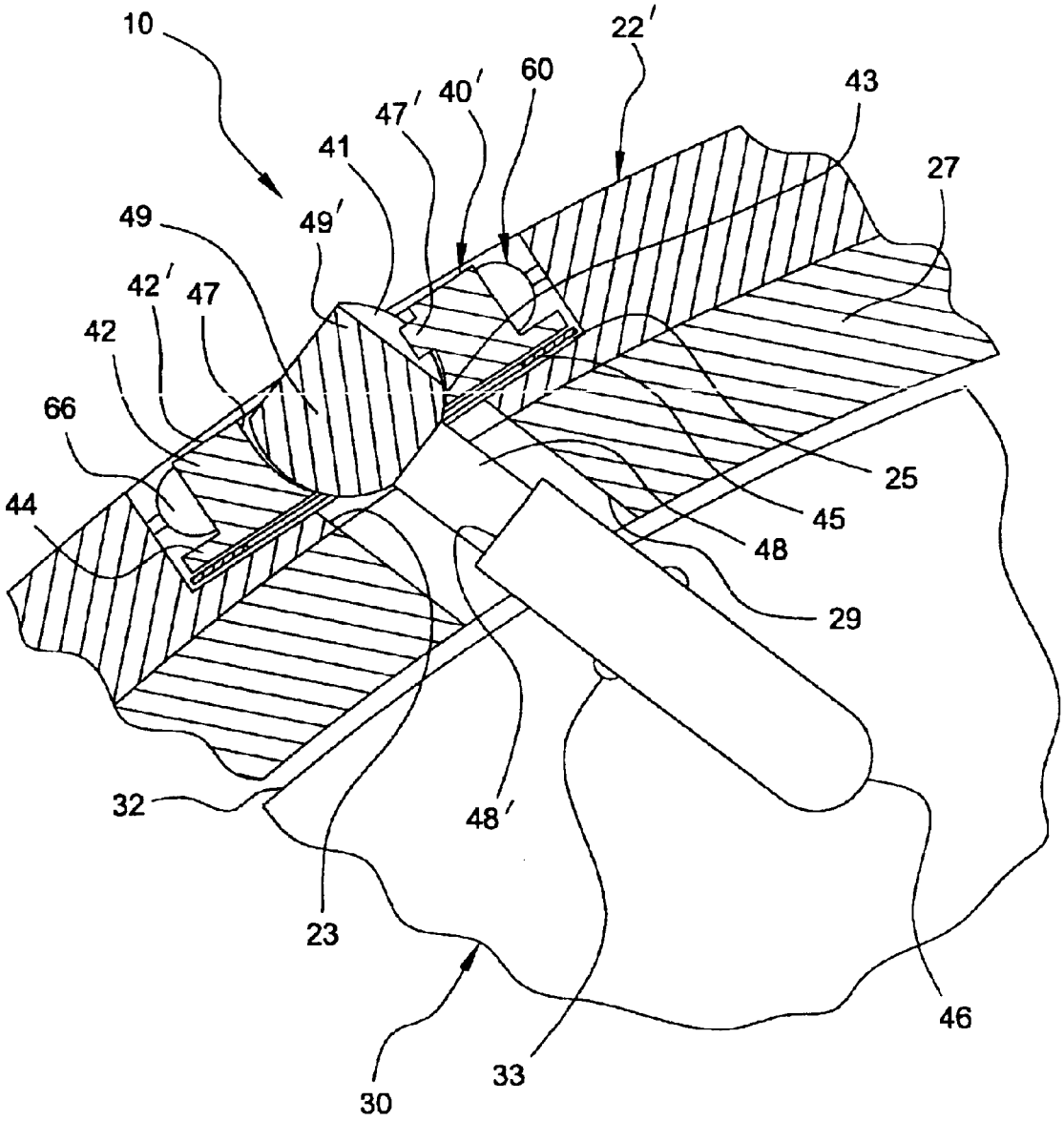
FIG. 7 represents a cross section view taken along line 7—7 in FIG. 1, showing the disposition of the headed pin within a sprocket assembly located next to one of the extreme portions in the arched frame member, where the blinds' axes are at a non-perpendicular angle with respect to the tangent of the arch at that point.

As shown in FIGS. 1 and 2, frame assembly 20 includes arched frame member 22 and straight frame member 26. Member 22 extends from one end of member 26 and joins the other end of member 26. Arched anchorage member 28 is centrally mounted on member 26 extending at a parallel and spaced apart relationship with respect to member 22 and also in a substantially concentric relationship thereto. Arched back member 22' serves as support for decoration arched cover member 22". Member 22' is perpendicularly mounted to member 22". Member 22' includes a number of recessed through openings 23 with counterbore shoulder 25, as best seen in FIG. 3. Frame assembly 20 also includes channel 24 and arched interior spacer member 27. Arched interior spacer member 27 is mounted under arched back member 22'. Arched interior spacer member 27 includes through openings 29 that are in a cooperative disposition with respect to recessed through openings 23, as best seen in FIGS. 6 and 7. Spacer member 27 provides sufficient clearance for arch compatible distal ends 32 of louvers 30 to rotate.

Figure 5:
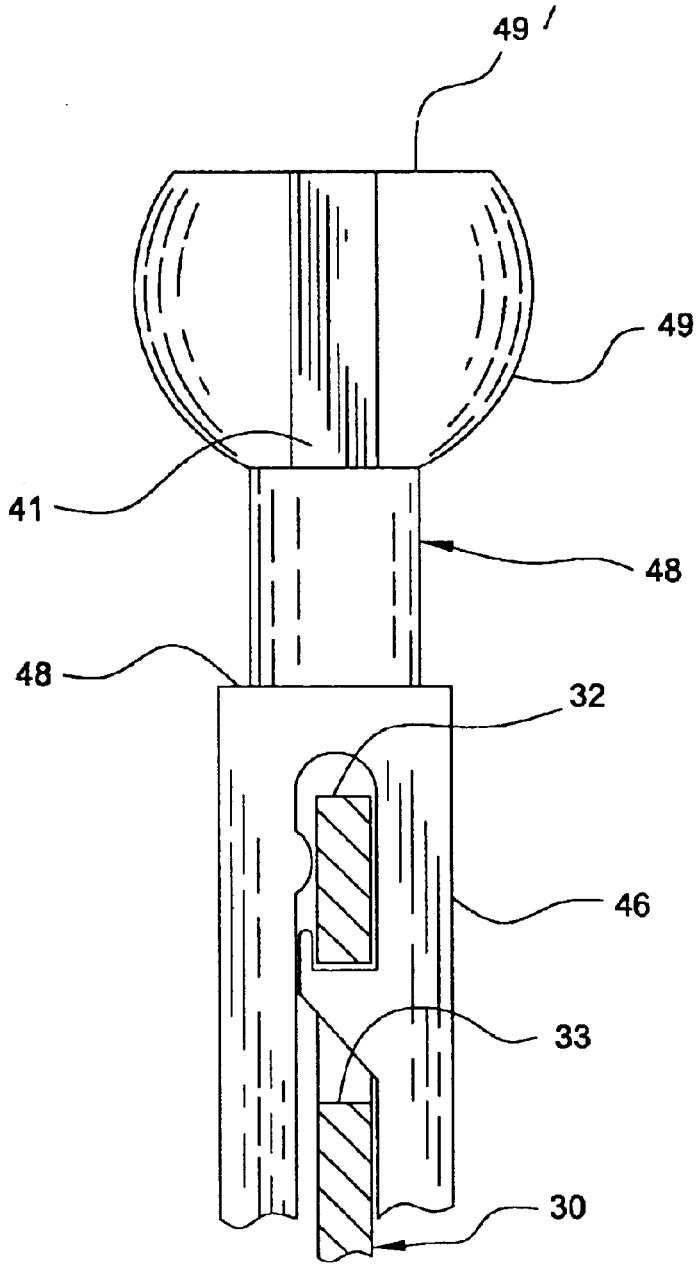
FIG. 5 is a front elevational view of the headed pin used with the sprocket assembly represented in FIG. 3, showing position of the channel.

Blinds or louver members 30 include distal end 32 and proximal end 34, as shown in FIGS. 1 and 2. Distal end 32 includes through opening 33 at a predetermined distance from end 32, as best seen in FIG. 6. Proximal end 34 includes through opening 35 at a predetermined distance from end 34. Blinds or louver members 30 have a substantially truncated triangular shape and are preferably made out of a rigid material. Their number and disposition is such that they cover the area within frame assembly 20. Through openings 29 of member 27 are in a cooperative disposition with respect to recessed through openings 23 to let pin members 38 go through. Member 27 covers the space between end 32 of blinds 30 and arched back member 22' avoiding the light to pass through when blinds 30 are in closed position, as best seen in FIGS. 5 and 6. In the preferred embodiment, actuating mechanism assembly 40 includes sprocket assembly 40', washer 45, louver holding pin member 48 and chain 60, as seen in FIG. 3. Sprocket assembly 40' has upper and lower ends and includes sprocket member 42 with built-in washer 44 rigidly mounted to its lower end. Built-in washer 44 rests on washer member 45 and the latter rests on counterbore shoulder 25 permitting sprocket assembly 40' to slidably rotate. Built-in washer 44 and washer member 45 coact with a relatively small friction coefficient. Sprocket member 42 includes central through opening 43 and socket 47 with an internal inwardly extending pin 47' adjacent to the upper end 42' of sprocket member 42. Pin member 48 includes headed end 49 with a truncated spherical shape, and surface 49'. Headed end 49 includes longitudinal channel 41 that extends perpendicularly from surface 49'. The lower end 48' of pin member 48 is rigidly mounted to louver clip member 46. Clip member 46 engages with through opening 33 of blind 30, as best seen in FIG. 5. Pin member 48 and louver clip member 46 have cooperative dimensions to pass through opening 43. Socket 47 has cooperative dimensions to receive headed end 49 and internal inwardly extending pin 47' is cooperatively disposed to be slidably received within longitudinal channel 41, so that rotating sprocket member 42 transmits the movement to pin 48 and clip member 46 and finally blind 30.

As seen in FIG. 3, washer member 45 includes perpendicularly mounted tongue 145, arms 245 and 245' and central through opening 345. Washer member 45 rests on counterbore shoulder 25. Arms 245 and 245' are positioned inside channel 24 adjacent to recessed through opening 23. Arms 245 and 245' prevent the rotation of washer member 45 with the movement of actuating mechanism assembly 40 and chain 60. Tongue 145 is positioned adjacent to the farthest wall of channel 24 providing a hard surface against which ball links 66 coact with sprocket assembly 40' causing ball links 66 of chain 60 to press against sprocket member 42.

In the preferred embodiment, tensioning assembly 50 includes anchoring members 54, mounted to arched anchorage member 28 at one urges blind or louver member 30 away from member 22' and keeping it tense, as seen in FIG. 1.

Chain 60 is of the ball chain type, preferably. As best seen in FIG. 3, chain 60 is housed within channel 24 on the outer surface of arched back member 22'. Chain 60 is preferably actuated by a user through actuating members 62 mounted to one end of chain 60, as seen in FIG. 1. Chain 60 slides inside channel 24 and meshes with sprocket 42 at a point where channel 24 passes tangentially next to recessed through opening 23, as best seen in FIG. 3. Ball links 66 of chain 60 cooperatively coact with sprocket member 42 to convert the translational movement of the former into rotational movement. Sprocket assembly 40' transmits the rotational movement to pin member 48 and clip 46 causing blind or louver member 30 to rotate.

By maintaining blinds or louver members 30 taut at ends 34, ends 32 are moved in tandem with chain 60. Mechanism 40 is actuated by a user, preferably through the use of actuating members 62 mounted at one end of chain 60, at a point located at one end of straight frame member 26, as seen in FIG. 1. The system is volumetrically efficient and thus capable of being mounted with minimum space requirements.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A louvered arch mechanism, comprising:

A) an arched frame assembly including a straight member with first and second ends, and an arched frame member extending from said first end to said second end, and further including an arched anchorage member centrally mounted to said straight member at a separate and spaced apart relationship with respect to said arched frame member;

B) a plurality of louver members each having third and fourth ends being rotably mounted between said arched frame member and said arched anchorage member;

C) tensioning means for keeping said louver members taut;

D) means for actuating said louver members including a plurality of sprocket means rotably mounted on said arched frame member and said sprocket means having upper and lower ends and including a central opening with an internal inwardly extending pin and further including built-in washer rigidly mounted to said lower end; and E) a corresponding plurality of louver clip members removably mounted centrally at said third ends and each having a pin member with a headed end having a truncated spherical shape and longitudinal channel that cooperatively receives said internal inwardly extending pin to transmit the rotational force imparted by said sprocket means to said louver members.

2. The louvered arch mechanism set forth in claim 1 wherein said arched frame member includes a channel that extends longitudinally thereon and a plurality of recessed through openings each having a counterbore shoulder partially overlapping said channel and said recessed through openings having cooperative dimensions to partially allow said louver clip members to go through and further including a plurality of washers and said counterbore shoulder supports one of said washers which in turn rotatably support said built-in washer of said sprocket means, and said means for actuating said louver members includes a chain with links that is kept within said channel and coacts with said sprocket means to transmit the translational movement of said chain to said sprocket means.

3. The louvered arch mechanism set forth in claim 2 wherein said plurality of washer members have cooperative dimensions to be receivable within said counterbore shoulders and being sandwiched between said counterbore shoulders and said plurality of sprocket means thereby facilitating the rotation of the latter.

4. The louvered arch mechanism set forth in claim 3 wherein said plurality of washers include tongues tangentially and perpendicularly mounted thereon and being positioned over said channel to coact with said links to provide a hard surface to ensure engagement of said links with said sprocket means, and said plurality of washers further include arms positioned inside said channel adjacent to said recessed through opening preventing the rotation of said plurality of washers with the movement of said plurality of sprocket means and said chain.

5. The louvered arch mechanism set forth in claim 4 wherein said means for actuating said louver members further includes actuating members mounted to said chain at said second end of said straight member.

6. The louvered arch mechanism set forth in claim 5 wherein said arched frame assembly further includes an arched interior spacer member mounted under said arched frame member and said arched interior spacer member including a plurality of through openings in cooperative disposition with respect to said plurality of recessed through openings and said arched interior spacer member providing sufficient clearance for said third ends of said louver members to rotate and block light when said blinds members are in closed position.

* * * * *